United States Patent [19]

Sasaki et al.

[11] Patent Number: 4,848,684

[45] Date of Patent: Jul. 18, 1989

[54] WOUND CORE HAVING CIRCULAR AND ELLIPTIC OUTER SURFACE PORTIONS

[75] Inventors: Hiromitsu Sasaki; Fumio Kitamura; Akiharu Koike, all of Chino, Japan

[73] Assignee: Kitamura Kiden Co., Ltd., Chino, Japan

[21] Appl. No.: 121,614

[22] Filed: Nov. 17, 1987

[30] Foreign Application Priority Data

Nov. 22, 1986 [JP] Japan ..... 61-277816
Nov. 25, 1986 [JP] Japan ..... 61-278712

[51] Int. Cl.[4] ..... H01F 27/24
[52] U.S. Cl. ..... 242/1; 336/212
[58] Field of Search ..... 242/7.01, 7.06, 7.07, 242/1; 336/234, 211, 212, 213, 221

[56] References Cited

U.S. PATENT DOCUMENTS

| | | | |
|---|---|---|---|
| 1,421,899 | 7/1922 | Bingay | 336/221 X |
| 2,220,732 | 11/1940 | Sanders | 242/7.03 X |
| 2,282,854 | 5/1942 | Driftmeyer | 242/7.07 X |
| 2,655,717 | 10/1953 | Dunn | 242/7.07 X |
| 3,066,388 | 12/1962 | Cooper | 242/7.07 X |
| 3,201,734 | 8/1965 | Halacsy | 336/221 |
| 3,464,041 | 8/1969 | Waterman | 336/212 X |
| 3,465,273 | 9/1969 | Brock | 29/605 X |
| 4,600,911 | 7/1986 | Meinert | 336/212 |

FOREIGN PATENT DOCUMENTS

| | | | |
|---|---|---|---|
| 58818 | 5/1977 | Japan | 336/213 |
| 55-132027 | 10/1980 | Japan . | |
| 60-28375 | 7/1985 | Japan . | |
| 61-22851 | 6/1986 | Japan . | |

*Primary Examiner*—Joseph J. Hail, III
*Attorney, Agent, or Firm*—Merchant, Gould, Smith, Edell, Welter & Schmidt

[57] ABSTRACT

In a wound core to which a cylindrical coil bobbin for windings may be applied, the beginning and/or end portions have a first outer surface with a non-circular elliptic, cross section and a second surface portion on having a circular cross section.

5 Claims, 6 Drawing Sheets

Fig. 5
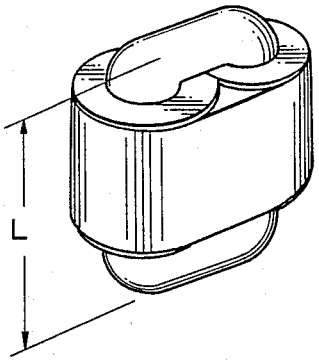
Fig. 6A
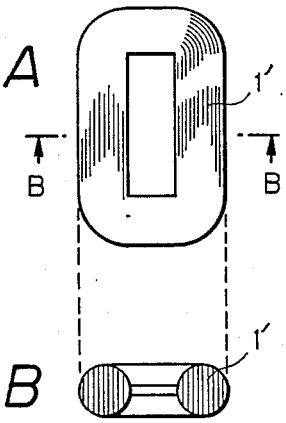
Fig. 6B
Fig. 7
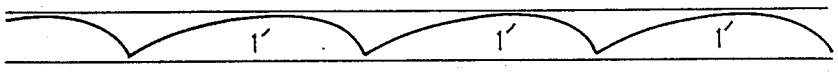
Fig. 8
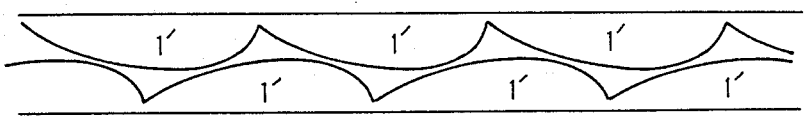

Fig. 9A
Fig. 9B
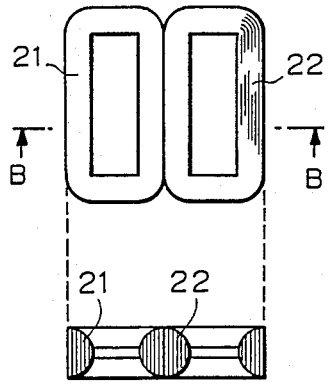
Fig. 10A
Fig. 10B
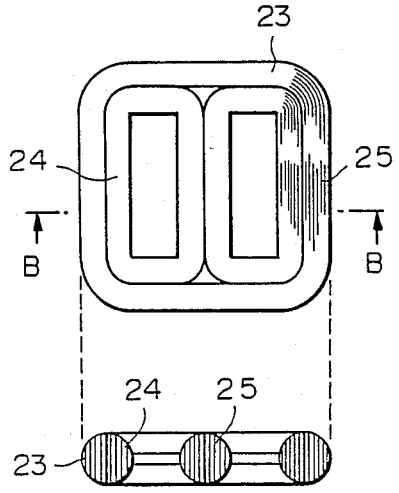

WOUND CORE HAVING CIRCULAR AND ELLIPTIC OUTER SURFACE PORTIONS

BACKGROUND OF THE INVENTION (1) Field of the Invention

The present invention relates to a wound core of a transformer to which cylindrical coil bobbins are applied and a method for manufacturing the same.

2) Description of the Related Art

As wound cores of transformers to which cylindrical coil bobbins are applied, circular cross sectional cores, which have advantages in that they are very thin, very small, and very light, the like, recently have been used (see: Japanese Examined Patent Publication (Kokoku) Nos. 60-28375 and 61-22851, and Japanese Unexamined Patent Publication (Kokai) No. 55-132027).

In the above-mentioned wound core, however, the beginning and end portions of a wound strip material may be deviated from the wound center thereof, and as a result, when a pressure welded coil bobbin is applied to the wound core and is rotated, the wound core scratches the inner surface of the coil bobbin, thereby seriously hindering the winding operation. Also, it sometimes becomes impossible to perform a pressure welding operation because the coil bobbin has split into two pieces, as explained later in detail.

SUMMARY OF THE INVENTION

Accordingly, an object of the present invention is to provide a wound core which avoids the scratching of the inner surface of the coil bobbin and allows the pressure welding of the coil bobbin, even when the beginning and end portions of the wound core are deviated from the center position.

Another object of the present invention is to provide an efficient method of cutting strips for the above-mentioned wound cores.

According to the present invention, in a wound core having a circular cross section, the beginning and/or end portions are elliptic, and in a wound core having a semicircular cross section, the beginning or end portion is elliptic. As a result, the scratching of the inner surface of the coil bobbin can be avoided and the pressure welding made possible. In this case, the air gap between the wound core and the coil bobbin is increased, but to the minimum amount.

Also, in a method for cutting strips for the above-mentioned wound core according to the present invention, a plurality of strips are continuously obtained without stopping the operation of a slitter apparatus.

BRIEF DESCRIPTION OF THE DRAWINGS

The present invention will be more clearly understood from the description as set forth below with reference to the drawings, wherein:

FIG. 5 is a perspective view illustrating the entire transformer including the wound core of FIG. 3A;

FIG. 6A is a plan view of the wound core of FIG. 3A;

FIG. 6B is a cross sectional view taken along the lines B—B of FIG. 6A;

FIGS. 7 and 8 are plan views explaining methods of cutting the strip of FIG. 3A;

FIG. 9A is a plan view of the wound core of FIG. 3B, which is applied to a single-phase shell type transformer;

FIG. 9B is a cross-sectional view taken along the lines B—B of FIG. 9A;

FIG. 10A is a plan view of the wound core of FIG. 3B, which is applied to a tripod three-phase type transformer;

FIG. 10B is a cross-sectional view taken along the lines B—B of FIG. 10A;

DESCRIPTION OF THE PREFERRED EMBODIMENTS

Figure 1:
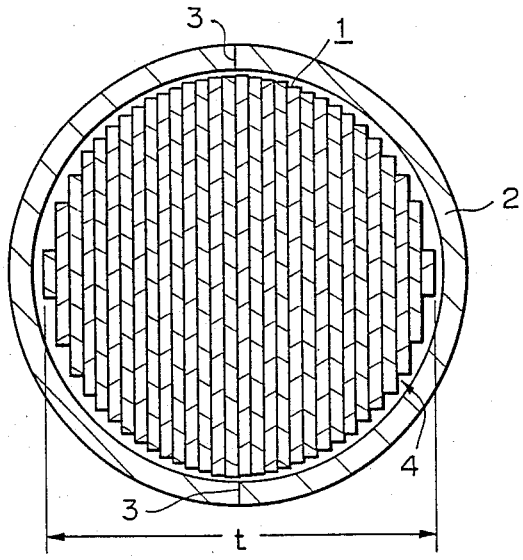
Fig. 1 PRIOR ART
FIG. 1 is a cross sectional view of a prior art wound core having a circular cross section, to which a cylindrical coil bobbin is applied.

Before describing the present invention, the prior art wound core will be explained with reference to FIGS. 1 and 2. In FIG. 1, a wound core 1 is obtained by winding strip material having excellent magnetic characteristics, which material is cut in advance to predetermined shapes. That is, the cross section of the wound core 1 is circular. For this wound core 1, two split pieces for a cylindrical coil bobbin 2 are pressure welded at pressure welding faces 3, and the windings (not shown) are wound onto the coil bobbin 2 by rotation. Therefore, in this case, an air gap 4 between the wound core 1 and the coil bobbin 2 is reduced, thus obtaining excellent magnetic characteristics.

Figure 2:
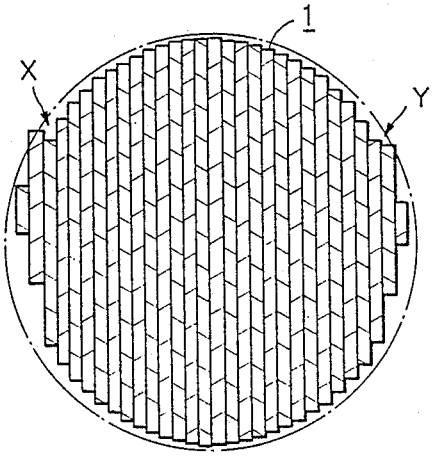
Fig. 2 PRIOR ART
FIG. 2 is a cross sectional view for explaining a problem in the wound core of FIG. 1.

In the wound core 1 of FIG. 1, however, the beginning and end portions of the stripped material may be deviated from the wound center thereof, as indicated by arrows X and Y in FIG. 2, in accordance with the winding apparatus (not shown) or the terminal processing operations. As a result, when the pressure welded coil bobbin 2 is rotated, the core 1 scratches the inner surface of the coil bobbin 2, particularly at the pressure weld portions 3, so that it is impossible to carry out a winding operation, and at worst, it becomes impossible to perform a pressure welding operation upon the coil bobbin 2.

Figure 3A:
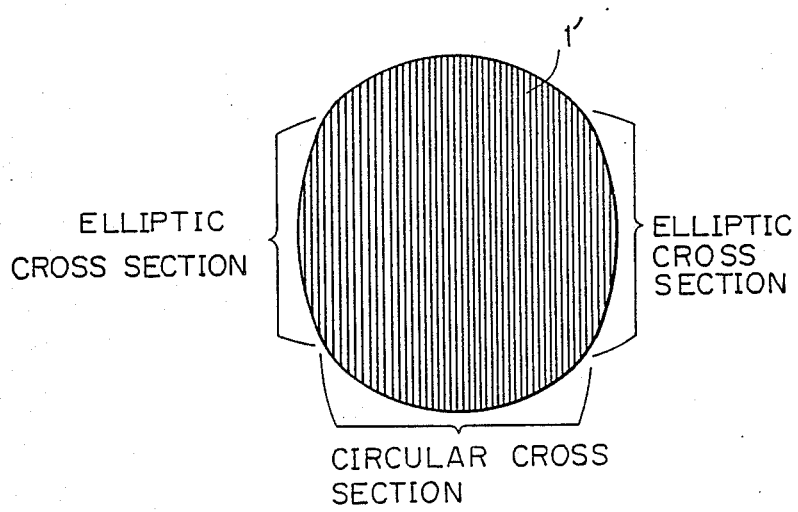
FIGS. 3A and 3B are cross sectional views illustrating embodiments of the wound core according to the present invention.

In the present invention, as illustrated in FIG. 3A, the cross section of the beginning and end portions of a wound core 1' is elliptic, and the cross sections of the other portions are circular; in the same way as in the prior art. Note, only one of the beginning and end portions need be elliptic.

Figure 3B:
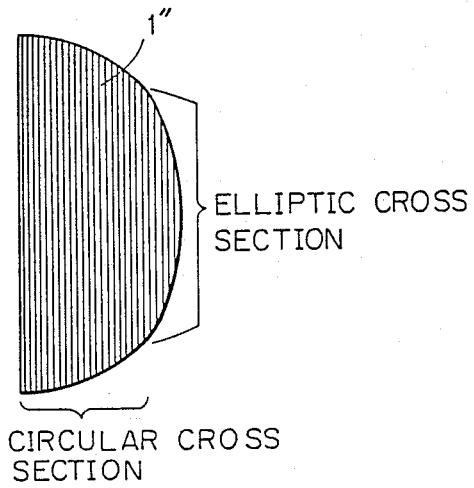

Also, a wound core applied to a single-phase shell type transformer or a tripod three-phase transformer has a semicircular cross section. In this case, according to the present invention as illustrated in FIG. 3B, the beginning or end portion is elliptic, and the other portions are circular.

Figure 4:
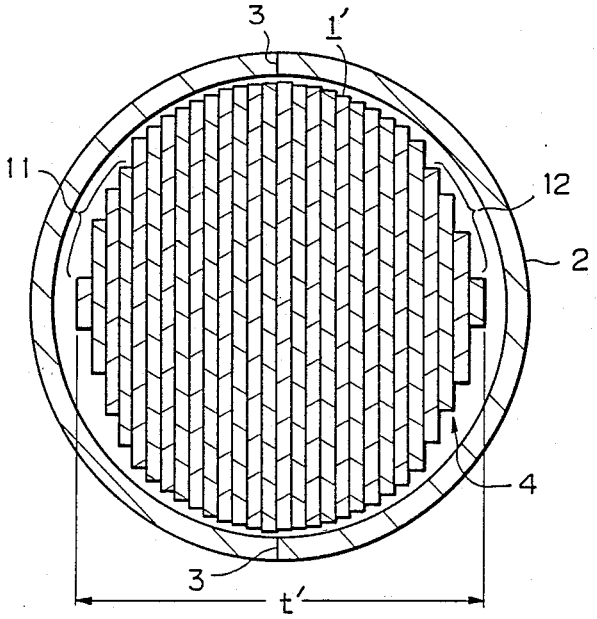
FIG. 4 is a cross sectional view of the wound core of FIG. 3A to which a cylindrical coil bobbin is applied.

Referring to FIG. 4, the wound core 1' of FIG. 3A will be explained in detail. In FIG. 4, the cross sections of a beginning portion 11 and an end portion 12 of the wound core 1' are elliptic. Therefore, the air gap 4' between the beginning portion 11 and the end portion 12 and the coil bobbin 2 is larger, compared with the prior art as shown in FIG. 1, but, this is the minimum amount. In the wound core 1′ as shown in FIG. 4, even when the beginning portion 11 and the end portion 12 are deviated from the winding center position, the air gap 4′ between these portions 11 and 12 and the coil bobbin 2 is large enough to avoid scratching of the inner surface of the coil bobbin 2, particularly, the pressure welding portions 3, or allow the pressure welding of the coil bobbin 2 are avoided.

Also, in the wound core 1′ of FIG. 4, the thickness t′ thereof is smaller than the thickness t of the prior art wound core 1 of FIG. 1. Therefore, the entire length L of the wound core 1′ as shown in FIG. 5, i.e., the total length of a transformer, is reduced, thus reducing the size of the transformer.

Note that, in the above-mentioned embodiment, although both the beginning and end portions are elliptic, only one thereof need be elliptic. In this case, the effect is a little reduced, but is still better than that of the prior art.

The wound core 1′ of FIG. 3A is illustrated in entirety in FIG. 6A. Note that FIG. 6B is a cross sectional view taken along the lines B—B of FIG. 6A. In view of the efficiency of utilization of the material and the ease of the cutting operation, when cutting strips for the wound core 1′, one of the straight sides of a material remains linear, and the other side is cut in accordance with a predetermined curve as illustrated in FIG. 7. Alternatively, both of the straight sides of a material remain linear, and cutting is carried out along two predetermined curves as illustrated in FIG. 8. In FIG. 8, one of the curves has concave portions opposing convex portions of the other curve, thereby enhancing the material efficiency.

Note that, in practice, the length of a strip for one wound core 1′ is very large, for example, about 20 m, but the width thereof is very small, for example, about 1 to 3 cm. Therefore, even when one side of the strip is straight and only the other side thereof is curved, the strip can be wound to form the wound core 1′ as illustrated in FIGS. 6A and 6B. Also, it is easy to determine the curves of FIGS. 7 and 8 by calculation in accordance with the shape of the wound core 1′, as illustrated in FIGS. 6A and 6B, and by the thickness of the material. Alternatively, a rectangular wound core can be cut and rounded to obtain the wound core 1′ as illustrated in FIG. 3A, and the obtained wound core 1′ then developed to obtain a model strip. As a result, the above-mentioned curves can be determined by actually measuring the width of the model strip.

Figure 11:
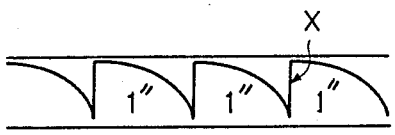
FIGS. 11 and 12 are plan views explaining methods of cutting strips for the wound core of FIG. 3B.
Figure 12:
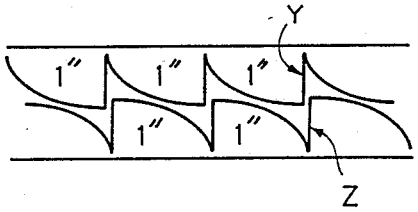

The semicircular wound core 1″ of FIG. 3B is applied to wound cores 21 and 22 of a single-phase shell type transformer as shown in FIGS. 9A and 9B, or to an outer core 23 and inner cores 24 and 25 of a tripod three-phase transformer as shown in FIGS. 10A and 10B, and the cutting of the strips is carried out as shown in FIG. 11 or 12, in the same way as in FIGS. 7 and 8. In FIGS. 11 and 12, however, sharp portions are generated in the cutting angle, as indicated by an arrow X in FIG. 11 or arrows Y and Z in FIG. 12. If such cutting is carried out by a slitter apparatus, the slitter apparatus must be stopped at such portions X, Y, and Z, and these portions cut by other means. Therefore, since the slitter apparatus usually operates so that the material moves at a speed of more than 200 m/min, the efficiency of the operation is remarkably reduced, thus increasing the cost of manufacturing the transformers (wound cores).

Figure 13:
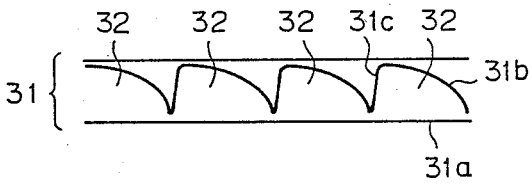
FIGS. 13 and 15 are plan views explaining methods of cutting strips for the wound core of FIG. 3B.
Figure 14:
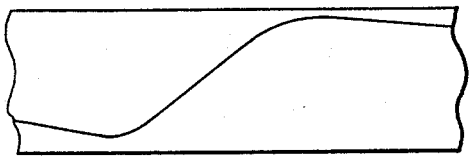
FIG. 14 is an enlargement of a part of FIG. 13.

In FIG. 13, which is a modification of FIG. 11, a material 31 has two straight lines on both sides. One of the sides 31*a* remains straight, and cutting is performed on the other side along a predetermined curve 31*b*, and thus a plurality of strips 32 are obtained. Note that the above-mentioned predetermined curve 31*b* is set so that the strips 32 are wound on a predetermined mold, thus obtaining the semicircular cross-sectional wound core 21, 22, or 23 as shown in FIGS. 9A, 9B, 10A, and 10B. That is, cutting is carried out along a line and/or a mild sloped curve 31*c*. Note that, in each of the cut strips 32, the length is actually about 500 times the width. Therefore, the curve 31*c* is a very mild sloped curve, as indicated by FIG. 14 which is an enlargement of FIG. 13. For example, the entire length of a strip is 20 m, and the mild sloped portion is about 5 cm. This portion is also wound as the wound case, and therefore, there is little loss. As a result, it is possible for the slitter apparatus (see Japanese Examined Patent Publication (Kokoku) No. 60-28375 and Japanese Unexamined Patent Publication (Kokai) No. 55-132057) to carry out a cutting operation along the curves 31*b* and 31*c* without stopping.

Figure 15:
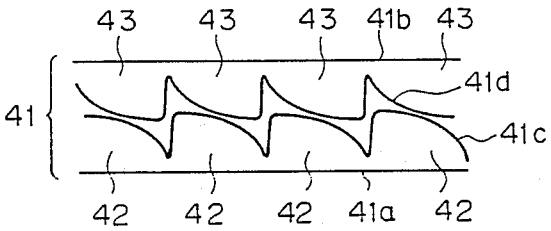

In FIG. 15, which is a modification of FIG. 12, both straight sides 41*a* and 41*b* of a material remain straight, and cutting is carried out simultaneously along two predetermined curves 41*c* and 41*d*, thereby obtaining a plurality of strips 42 and 43. In this case, the concave and convex portions of a plurality of strips 42 oppose the convex and concave portions of a plurality of strips 43, respectively, thereby increasing the efficiency of utilization of the material.

Note that the cutting method as shown in FIGS. 13 and 15 can be easily carried out by using the slitter apparatus as shown in Japanese Examined Patent Publication (Kokoku) No. 60-28375 or Japanese Unexamined Patent Publication (Kokai) No. 55-132027.

As explained above, according to the present invention, even when both or one of the beginning and end portions are deviated from the wound center position, scratching of the inner surfaces of coil bobbins can be avoided and the pressure welding of the coil bobbins can be allowed. Also, strips for semicircular cross-sectional wound cores having an excellent operational efficiency can be obtained.

We claim:

1. An inductive arrangement for use in a transformer or other electromagnetic apparatus, comprising:
   - a coil bobbin having a space defined therein by a cylindrical inner surface;
   - a core body positioned within said space; said core body having an axis; and
   - an outer surface on said core body, said outer surface having a first circular surface portion extending along a constant radius from said axis, and a second non-circular surface portion which extends along an elliptical path in a plane perpendicular to said axis, and wherein said circular surface portion conforms closely to said inner surface of said coil bobbin.

2. An inductive arrangement according to claim 1, wherein said first and second surface portions are contiguous.

3. An inductive arrangement according to claim 1, wherein there are two of said first circular surface portions and two of said non-circular surface portions.

4. An inductive arrangement according to claim 3, wherein said two first surface portions are on opposite sides of said axis; and said two second surface portions are on opposite sides of said axis; and each of said first surface portions is contiguous with both of said second surface portions.

5. An inductive arrangement according to claim 1, wherein said outer surface further has a third substantially planar portion; whereby the wound core is given a substantially semicircular shape in cross section.

* * * * *